US007540573B2

(12) United States Patent
Lin

(10) Patent No.: US 7,540,573 B2
(45) Date of Patent: Jun. 2, 2009

(54) CABINET WITH A SAFETY DEVICE

(76) Inventor: Ching-Hsiang Lin, No. 6, Alley 1, Lane 3-22, Anlin Rd., Taichung City (TW)

( * ) Notice: Subject to any disclaimer, the term of this patent is extended or adjusted under 35 U.S.C. 154(b) by 468 days.

(21) Appl. No.: 11/512,114

(22) Filed: Aug. 30, 2006

(65) Prior Publication Data

US 2008/0054768 A1 Mar. 6, 2008

(51) Int. Cl.
*E05C 7/06* (2006.01)

(52) U.S. Cl. ..... 312/221; 312/217; 312/219; 312/220; 312/222; 70/85

(58) Field of Classification Search ..... 312/107.5, 312/902, 216, 217, 218, 219, 220, 221, 222; 70/78, 79, 80, 81, 82, 83, 84, 85
See application file for complete search history.

(56) References Cited

U.S. PATENT DOCUMENTS 3,323,849 A * 6/1967 Stark ..... 312/221
3,909,090 A * 9/1975 Breckner et al. ..... 312/217
6,634,726 B1 * 10/2003 Slivon ..... 312/221
6,969,129 B2 * 11/2005 Ludwig et al. ..... 312/217

* cited by examiner

*Primary Examiner*—Khoa D Huynh
*Assistant Examiner*—Salvatore D Zagarella
(74) *Attorney, Agent, or Firm*—Bacon & Thomas, PLLC

(57) ABSTRACT

A cabinet has a housing, multiple tracks, multiple drawers, a safety device and a lock assembly. Each track has a sliding rail having a guiding notch and a locking hole. The safety device is mounted in the housing and has a fixed base, a moving base, multiple locking blocks, multiple locking tongues, multiple guiding posts and multiple guiding blocks. The locking blocks are securely attached to the moving base and each have a locking tab. The locking tongues are mounted respectively on the drawers and selectively aligning with the locking tabs on the locking blocks. The guiding posts are mounted on the moving base and locate respectively above the locking blocks. The guiding blocks are slidably and respectively attached to of the tracks. Each guiding block has an inclined face and corresponding to and selectively abutting with a corresponding one of the guiding posts.

6 Claims, 7 Drawing Sheets

CABINET WITH A SAFETY DEVICE

BACKGROUND OF THE INVENTION

1. Field of the Invention

The present invention relates to a cabinet, and more particularly to a cabinet with a safety device to keep drawers from sliding out unintentionally.

2. Description of Related Art

With reference to FIG. 7, a conventional tool cabinet substantially comprises a housing (70), multiple drawers (71) to store tools inside and multiple wheels (72) attached to the housing (70) to allow the cabinet to move conveniently.

However, the drawers (71) may slide out accidentally while the cabinet is moving, the tools inside the drawers (71) may be scattered over a floor and persons near the cabinet may be injured. Therefore, a safety device is mounted on a cabinet to keep the drawers (71) from sliding out unintentionally. However, when the safety device is unlocked, all of the drawers (71) are at a unlocked condition and a user can open multiple drawers (71) simultaneously. When multiple drawers (71) are opened simultaneously, the center of gravity of the cabinet will be shifted and the cabinet easy turns over and results dangers to the user.

To overcome the shortcomings, the present invention tends to provide a cabinet to mitigate or obviate the aforementioned problems.

SUMMARY OF THE INVENTION

The main objective of the invention is to provide a cabinet that can keep the drawers from sliding out unintentionally and allows only one drawer to be opened at one time. The cabinet has a hollow housing, multiple tracks, multiple drawers, multiple wheels, a safety device and a lock assembly. The tracks are attached respectively to sides of the housing in parallel and are arranged in pairs. Each track comprises a securing rail securely attached the housing and a sliding rail slidably mounted on the securing rail. The drawers are mounted respectively and slidably between corresponding pairs of the tracks. The wheels are attached to the bottom of the housing. The safety device is mounted in the housing and comprises a fixed base, a moving base, multiple locking blocks, multiple locking tongues, multiple guiding posts and multiple guiding blocks. The fixed base is elongated and is longitudinally attached to one side of the housing. The moving base is slidably mounted on the fixed base and has a hole defined through the moving base. The locking blocks are securely attached to the moving base and correspond respectively to bottoms of the tracks on the side of the housing on which the safety device is mounted. Each locking block has a locking tab mounted on the locking block. The locking tongues are mounted respectively on the drawers, correspond respectively to the locking blocks and selectively aligning with the locking tabs on the locking blocks. The guiding posts are mounted on the moving base and locate respectively above the locking blocks. The guiding blocks are slidably and respectively attached to of the tracks on the side of the housing on which the safety device is mounted. Each guiding block has a top and an inclined face defined in the top and corresponding to and selectively abutting with a corresponding one of the guiding posts. The lock assembly is attached to the housing, corresponds to the safety device and has a locking bolt rotatably extending into the hole in the moving base.

Other objects, advantages and novel features of the invention will become more apparent from the following detailed description when taken in conjunction with the accompanying drawings.

DETAILED DESCRIPTION OF PREFERRED EMBODIMENT

Figure 1:
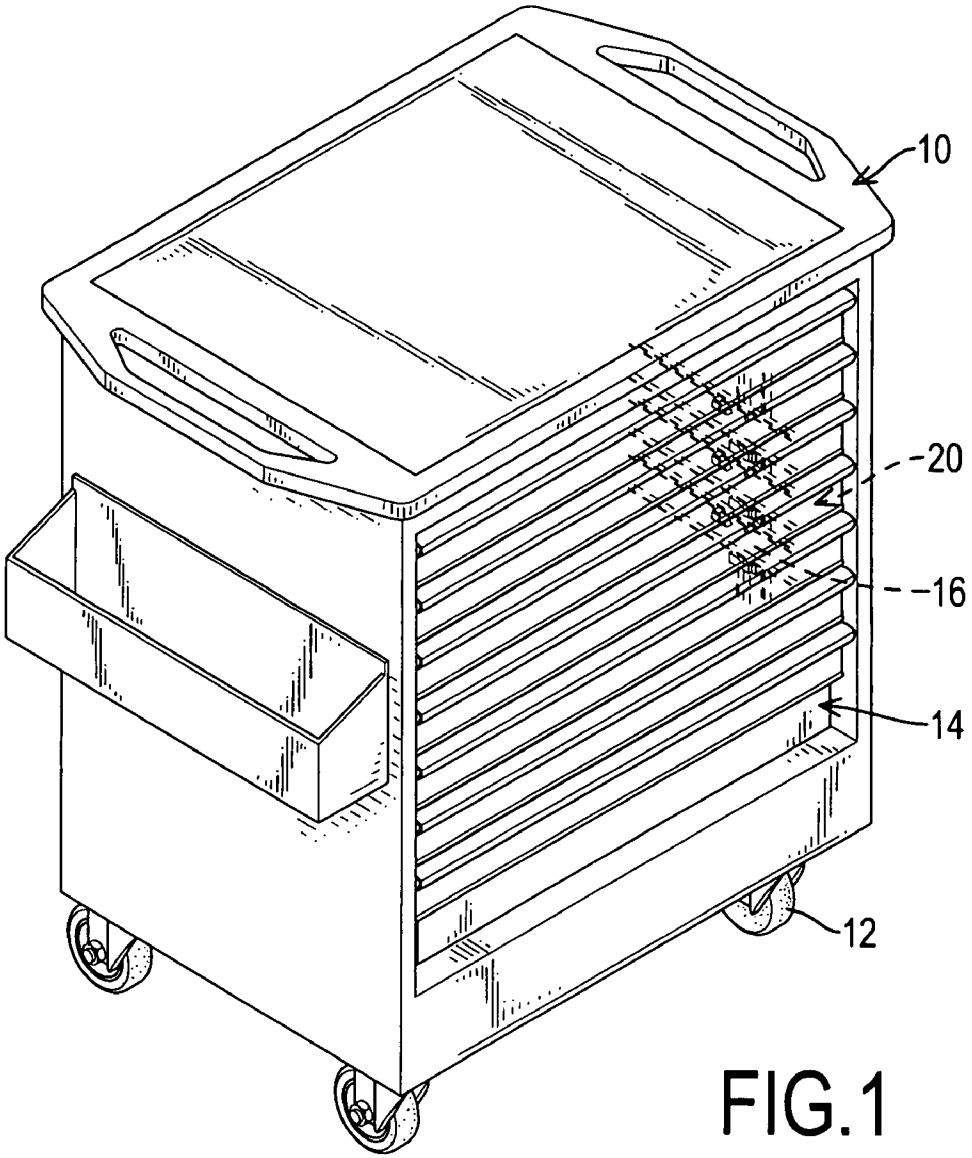
FIG. 1 is a perspective view of a cabinet in accordance with the present invention.
Figure 2:
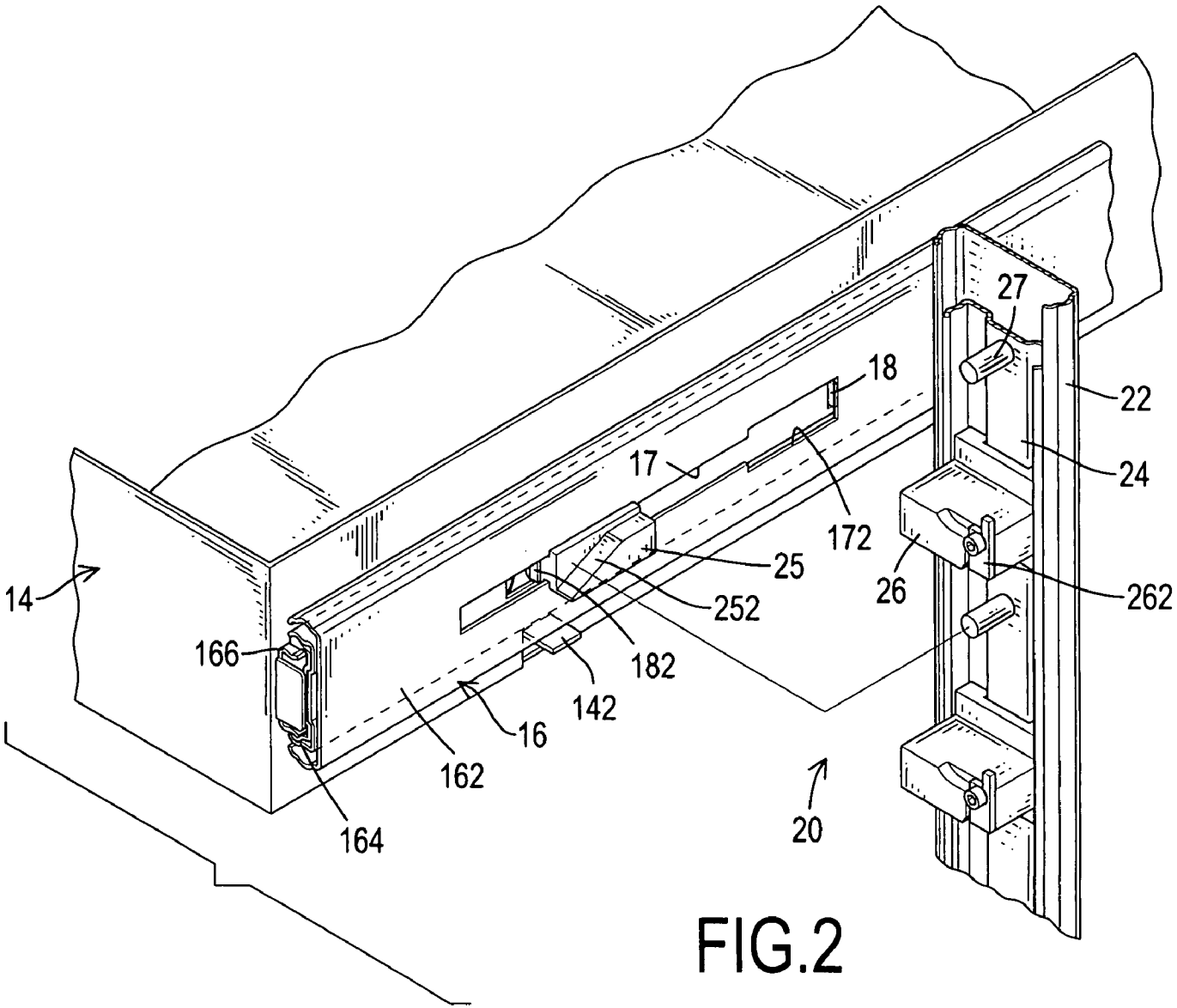
FIG. 2 is an exploded perspective view of the safety device and one track of the cabinet in FIG. 1.
Figure 4:
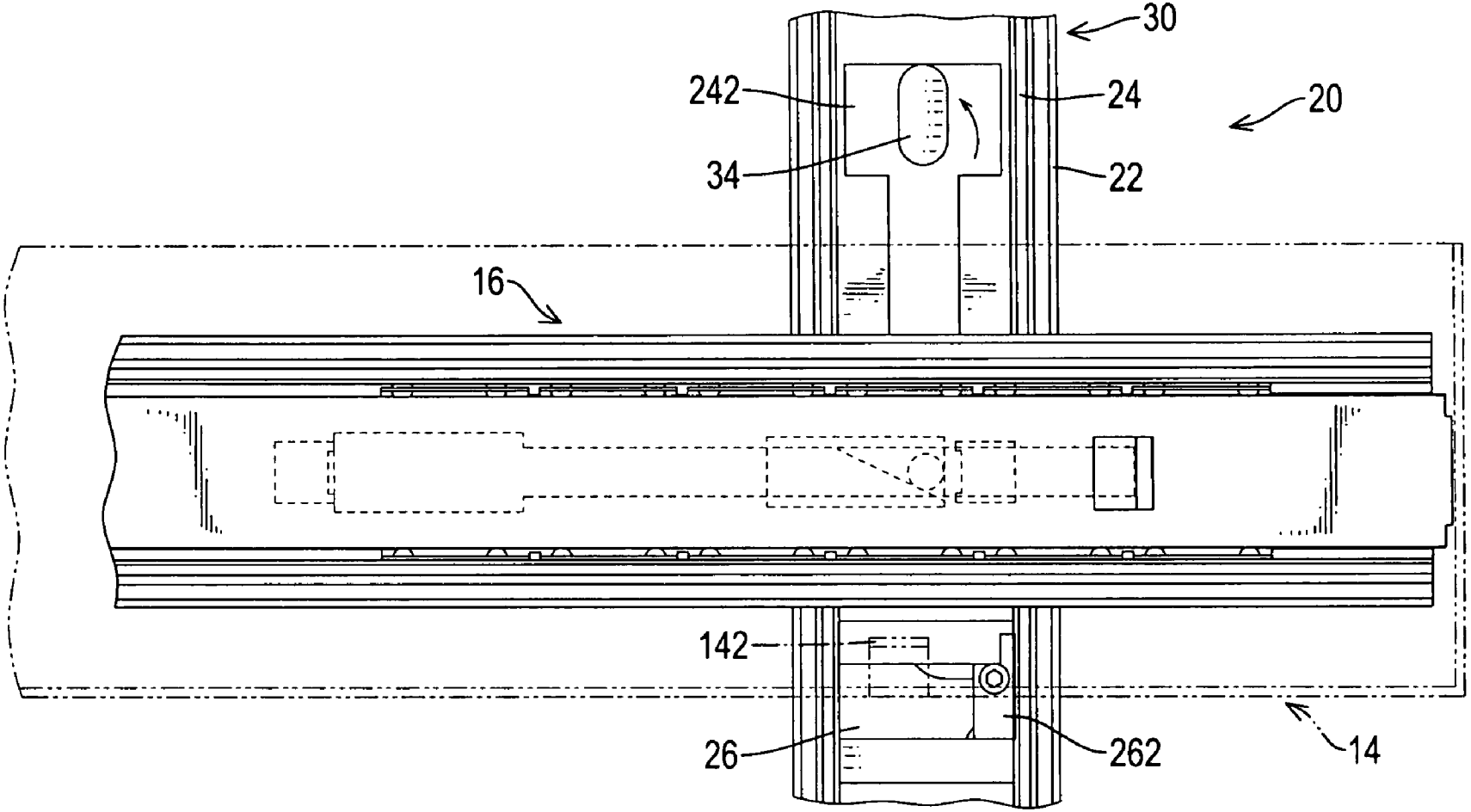
FIG. 4 is an operational side plan view of the safety device of the cabinet in FIG. 2 showing that all of the drawers are in a locked condition.

With reference to FIGS. 1, 2 and 4, a cabinet in accordance with the present invention comprises a housing (10), multiple tracks (16), multiple drawers (14), multiple wheels (12), a safety device (20) and a lock assembly (30).

The housing (10) is hollow and has two sides, a bottom and an open front. The tracks (16) are attached respectively to the sides of the housing (10) in parallel and are arranged in pairs. Each track (16) comprises a securing rail (162) securely attached the housing (10), a sliding rail (164) slidably mounted on the securing rail (162) and a roller race (166) slidably mounted on the sliding rail (164). The roller race (166) has multiple rollers and is attached to one of the drawers (14) to allow the drawer (14) to move along the track (16) at a lower friction. The drawers (14) are mounted respectively between the roller races (166) of corresponding pairs of the tracks (16). The wheels (12) are attached to the bottom of the housing (10) to allow the cabinet to be moved conveniently.

The safety device (20) is mounted in the housing (10) and comprises a fixed base (22), a moving base (24), multiple locking blocks (26), multiple locking tongues (142), multiple guiding posts (27) and multiple guiding blocks (25). The fixed base (22) is elongated and is longitudinally attached to one side of the housing (10).

The moving base (24) is slidably mounted on the fixed base (22). The moving base (24) has a hole (242) defined through the moving base (24).

The locking blocks (26) are securely attached to the moving base (24) and correspond respectively to the bottoms of the tracks on the side of the housing (10) on which the safety device (20) is mounted. Each locking block (26) has a locking tab (262) mounted on the locking block (26). In a preferred embodiment, the locking tab (262) is pivotally mounted on the locking block (26).

The locking tongues (142) are formed respectively on the drawers and respectively correspond to and selectively abut with the locking tabs (262) on the locking blocks (26).

The guiding posts (27) are mounted on the moving base (24) and locate respectively above the locking blocks (26).

The guiding blocks (25) are mounted on the tracks (16) and correspond respectively to the guiding posts (27). Each guiding block (25) is slidably mounted on one of the tracks (16), is moved with the sliding rail (164) of the corresponding track (16) and has a top and an inclined face (252) defined in the top. In a preferred embodiment, the securing rail (162) of each track (16) corresponding to the safety device (20) has a guiding channel (17) defined through the securing rail (162) to slidably hold a corresponding guiding block (25) inside. A through hole (172) is defined through the securing rail (162) and communicates with the guiding channel (17) to serve as an entrance for the guiding block (25) entering into the guiding channel (17). The sliding rail (164) has two pushing tabs (18,182) extending into the guiding channel and the through hole in the securing rail and locate respectively at two sides of the guiding block (25). When sliding rail (164) moves relative to the securing rail (162), the guiding block (25) will be pushed to move relative along the guiding channel (17) by one of the pushing tabs (18,182).

The lock assembly (30) is attached to the housing (10), corresponds to the safety device (20) and has a lock cylinder. The lock cylinder is attached to the housing (10) and has a locking bolt (34) rotatably extending into the hole (242) in the moving base (24).

When a key is inserted into and rotates the lock cylinder, the rotated locking bolt (34) will push the moving base (24) to move upward relative to the fixed base (22). Accordingly, the locking tabs (262) on the locking blocks (26) are moved upward to align with the locking tongues (142) on the drawers (14). With the abutments between the locking tabs (262) and the locking tongue (142), a locking effect is provided to the drawers (14) and the drawers (14) cannot be opened. Therefore, the drawers (14) will not slide out unintentionally while the cabinet is moved, and this can keep persons near the cabinet from being injured.

Figure 3:
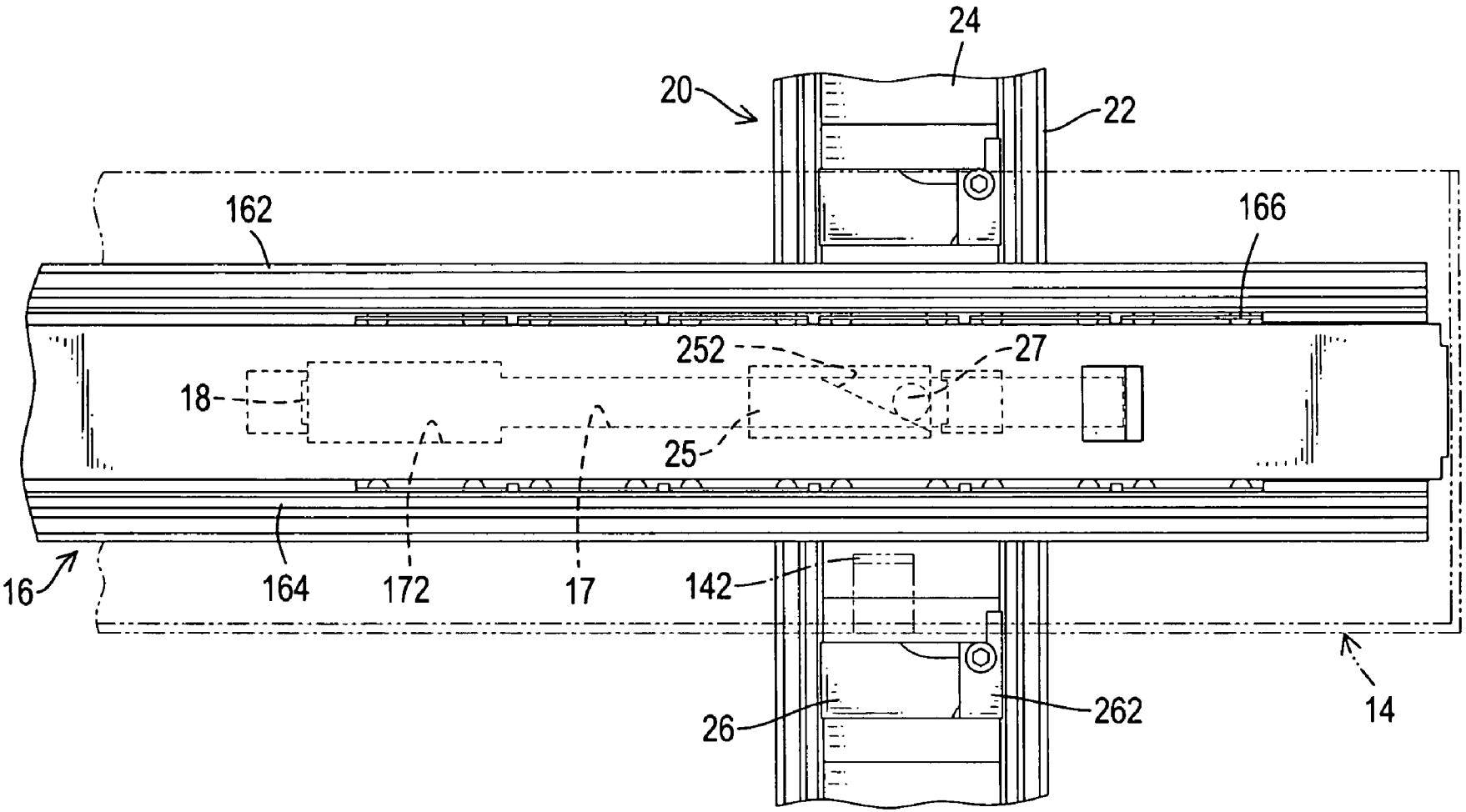
FIG. 3 is a side plan view of the safety device of the cabinet in FIG. 2.
Figure 5:
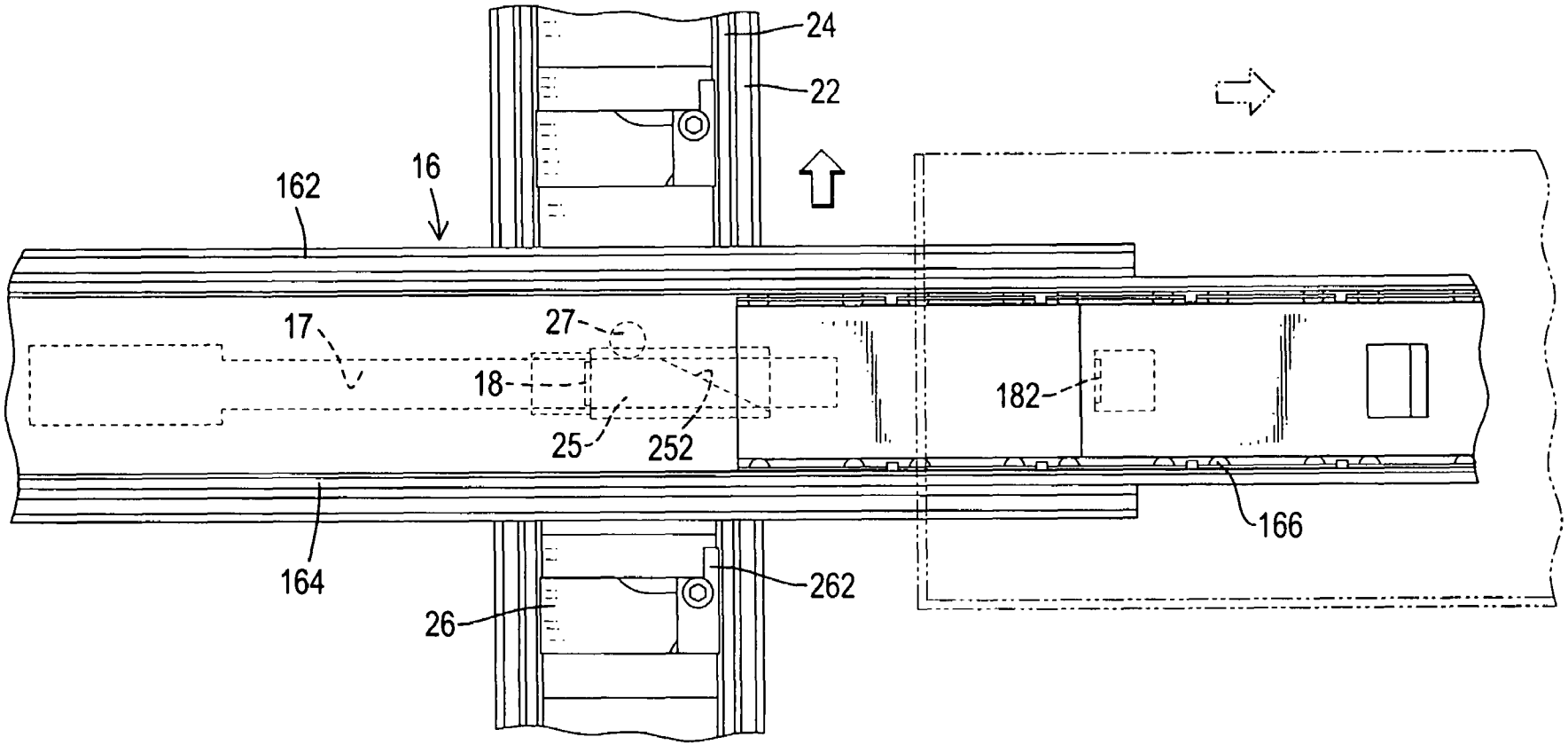
FIG. 5 is an operational side plan view of the safety device of the cabinet in FIG. 2 showing that one of the drawers is opened.
Figure 6:
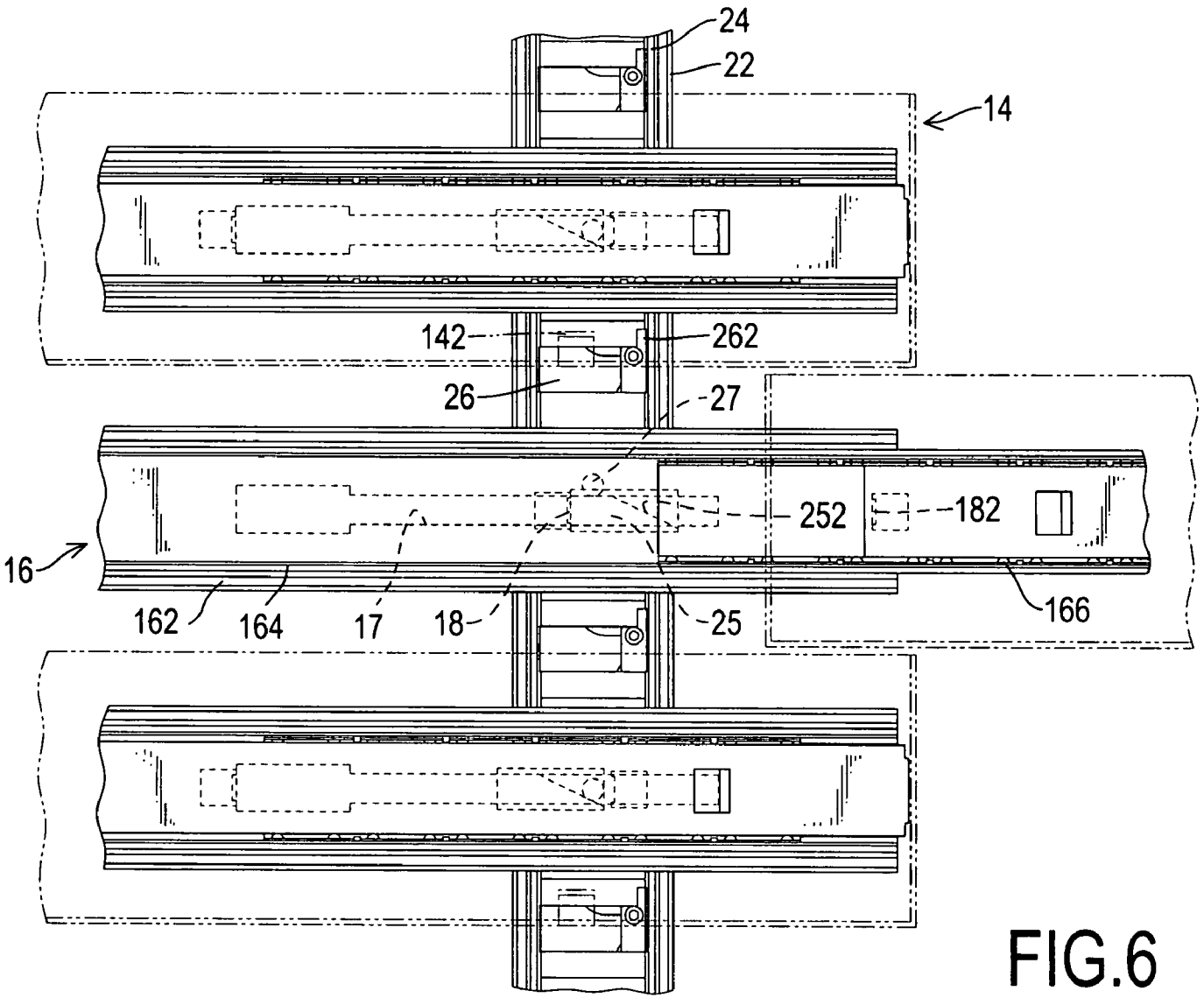
FIG. 6 is an operational side plan view of the safety device of the cabinet in FIG. 2 showing that the other drawers are in a locked condition when a drawer is opened.
Figure 7:
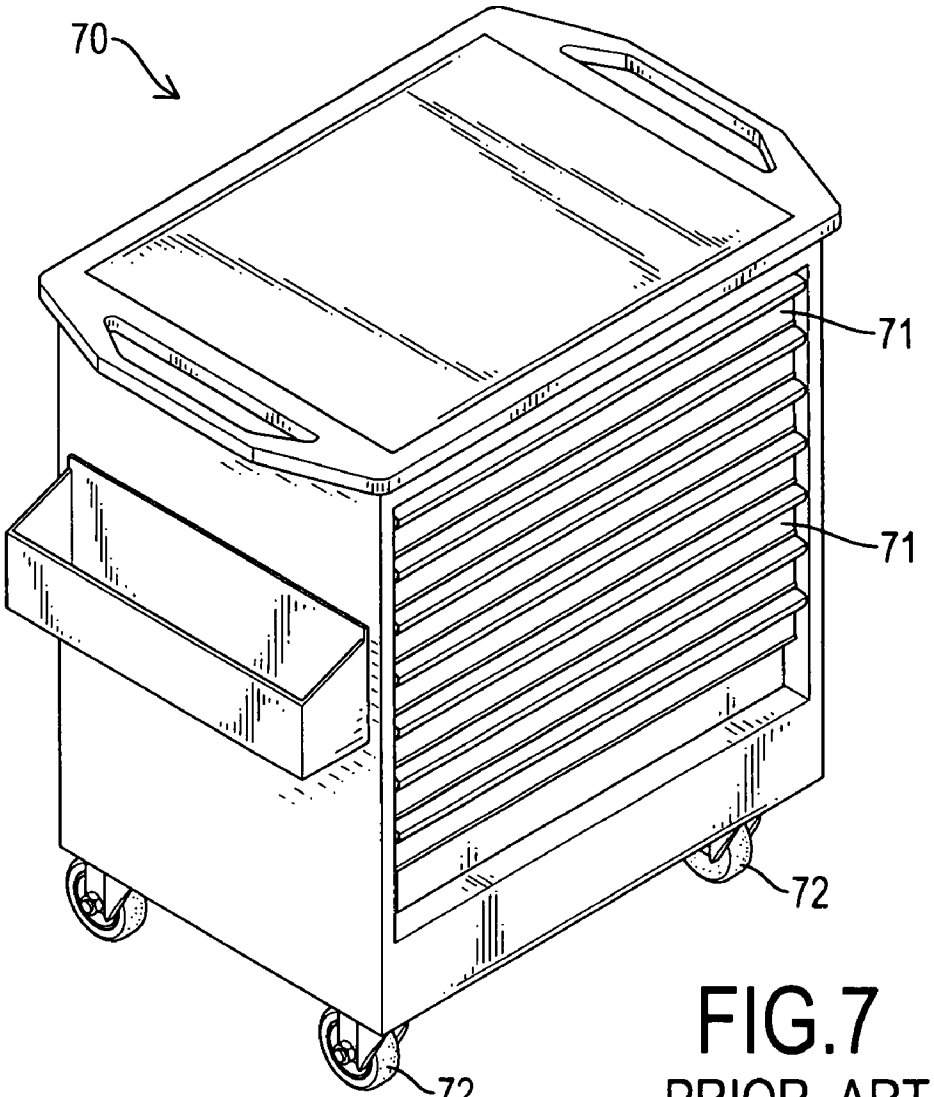
FIG.7 PRIOR ART
FIG. 7 is a perspective view of a conventional cabinet in accordance with the prior art.

With reference to FIGS. 3, 5 and 6, when the key is rotated to unlock the lock cylinder (32), the locking bolt (34) is rotated to a position where not supporting the moving base (24) and the moving base (24) moves downward with the weight of the moving base (24) and the blocks (25,26) on the moving base (24). With the downward movement of the moving base (24), the locking tabs (262) on the locking blocks (26) do not align with the locking tongues (142) so that the drawers (14) can be opened. When the user pulls one of the drawers (14) out from the open front of the housing (10), roller races (166) and the sliding rails (164) attached to the pulled drawer (14) will slide relative to the securing rails (162). With the movement of the sliding rail (164), the guiding block (25) will be pushed by one of the pushing tabs (18) to move along the guiding channel (17) and the inclined face (252) on the guiding block (25) will abut against the corresponding guiding post (27). Thus, the guiding post (27) will move along the inclined face (252) on the corresponding guiding block (25) and push the guiding block (25) to move upward. Consequently, the moving base (24) with the locking blocks (26) will be also pushed to move upward, such that the locking tabs (262) will be move to a position where align with the locking tongue (142) on the unmoved drawers (14). Accordingly, the other drawers (14) will not be opened due to the abutment of the locking tabs (262) and the locking tongues (142). Therefore, only one drawer (14) can be opened at one time, and this can keep multiple drawers (14) from being opened simultaneously and the center of the gravity of the cabinet from shifting.

When the opened drawer (14) is pushed back into the housing (10), the guiding block (25) will be pushed backward along the guiding channel (17) by the other pushing tab (182). The moving base (24) will move downward with gravity due to the downward movement of the guiding post (27) along the inclined face (252) on the guiding block (25). Consequently, the locking tabs (262) on the locking blocks (26) will leave from the position where align with the locking tongues (142) on the drawers (14), such that the user can open another drawer (14) to take and use tools inside.

The safety device in accordance with the present invention has a simplified structure, and the cost for manufacturing and assembling the safety device on a tool cabinet is lowered.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cabinet comprising:

a hollow housing having two sides and a bottom;

multiple tracks attached respectively to the sides of the housing in parallel and arranged in pairs and each track comprising a securing rail securely attached the housing and a sliding rail slidably mounted on the securing rail;

multiple drawers mounted respectively and slidably between corresponding pairs of the tracks;

multiple wheels attached to the bottom of the housing;

a safety device mounted in the housing and comprising an elongated fixed base longitudinally attached to one side of the housing;

a moving base slidably mounted on the fixed base and having a hole defined through the moving base;

multiple locking blocks securely attached to the moving base and corresponding respectively to bottoms of the tracks on the side of the housing on which the safety device is mounted, and each locking block having a locking tab mounted on the locking block;

multiple locking tongues mounted respectively on the drawers, corresponding respectively to the locking blocks and selectively aligning with the locking tabs on the locking blocks;

multiple guiding posts mounted on the moving base and locating respectively above the locking blocks; and multiple guiding blocks slidably and respectively mounted on the tracks on the side of the housing on which the safety device is mounted, and each guiding block having a top and an inclined face defined in the top and corresponding to and selectively abutting with a corresponding one of the guiding posts; and a lock assembly attached to the housing, corresponding to the safety device and having a locking bolt rotatably extending into the hole in the moving base, wherein the movement of one of the drawers is initiated by the sliding rails and with the movement of the sliding rails, the guiding blocks are pushed to move along the inclined faces on the guiding blocks which abuts the corresponding guiding posts, the guiding posts in turn move along the inclined faces and pushes the moving base with the locking blocks upward, such that the locking tabs align and abut with the respective locking tongues on the unmoved drawers to prevent other drawers from being opened.

2. The cabinet as claimed in claim 1, wherein each locking tab is pivotally mounted on a corresponding locking block.

3. The cabinet as claimed in claim 2, wherein the securing rail of each track corresponding to the safety device has a guiding channel defined through the securing rail to slidably hold a corresponding guiding block inside; and the sliding rail of each track corresponding to the safety device has two pushing tabs extending into a corresponding one of the guiding channels and locating respectively at two sides of a corresponding guiding block.

4. The cabinet as claimed in claim 3, wherein the securing rail of each track corresponding to the safety device further has a through hole through the securing rail and communicating with a corresponding guiding channel to serve as an entrance for the corresponding guiding block entering into the corresponding guiding channel.

5. The cabinet as claimed in claim 1, wherein the securing rail of each track corresponding to the safety device has a guiding channel defined through the securing rail to slidably hold a corresponding guiding block inside; and the sliding rail of each track corresponding to the safety device has two pushing tabs extending into a corresponding one of the guiding channels and locating respectively at two sides of a corresponding guiding block.

6. The cabinet as claimed in claim 5, wherein the securing rail of each track corresponding to the safety device further has a through hole through the securing rail and communicating with a corresponding guiding channel to serve as an entrance for the corresponding guiding block entering into the corresponding guiding channel.

* * * * *